US007546858B2

(12) United States Patent
Peterson et al.

(10) Patent No.: US 7,546,858 B2
(45) Date of Patent: Jun. 16, 2009

(54) PENCIL SHARPENER

(75) Inventors: Michael E. Peterson, Fairfield, CT (US); Stuart David Farnworth, Westport, CT (US); James E. McCay, Fairfield, CT (US)

(73) Assignee: Acme United Corporation, Fairfield, CT (US)

( * ) Notice: Subject to any disclaimer, the term of this patent is extended or adjusted under 35 U.S.C. 154(b) by 405 days.

(21) Appl. No.: 11/451,753

(22) Filed: Jun. 12, 2006

(65) Prior Publication Data

US 2006/0288593 A1 Dec. 28, 2006

Related U.S. Application Data

(60) Provisional application No. 60/692,906, filed on Jun. 22, 2005.

(51) Int. Cl.
*B43L 23/00* (2006.01)

(52) U.S. Cl. ..... 144/28.72; 144/28.2; 144/28.4

(58) Field of Classification Search ..... 144/28.2, 144/28.4–28.6, 28.71, 28.72, 28.8, 28.9; 30/451, 453–455, 457–459, 462
See application file for complete search history.

(56) References Cited

U.S. PATENT DOCUMENTS

| | | | | | |
|---|---|---|---|---|---|
| 1,611,141 | A | * | 12/1926 | Fisher | 144/28.5 |
| 2,545,779 | A | * | 3/1951 | Harrison | 144/28.5 |
| 2,991,757 | A | * | 7/1961 | Dahle | 144/28.7 |
| 3,237,607 | A | * | 3/1966 | O'Brien | 144/28.71 |
| 4,966,208 | A | * | 10/1990 | Uang | 144/28.72 |
| 6,470,929 | B2 | * | 10/2002 | Fregeolle | 144/28.72 |

FOREIGN PATENT DOCUMENTS

JP 6312598 * 11/1994

* cited by examiner

*Primary Examiner*—Shelley Self
(74) *Attorney, Agent, or Firm*—Alix, Yale & Ristas, LLP

(57) ABSTRACT

A pencil sharpener includes a base having a bottom surface adapted for being supported by a horizontal surface. A cutting assembly is mounted to the base and projects upwardly therefrom. A cage is disposed above the base and has an upper portion surrounding the cutting assembly. The upper portion of the cage includes at least one radial chute. An upper cover portion has an opening for insertion of an end of a pencil. A receptacle disposed above the base surrounds the cage, for collecting the shavings from sharpening a pencil.

20 Claims, 3 Drawing Sheets

PENCIL SHARPENER

CROSS-REFERENCE TO RELATED APPLICATIONS

This application claims the benefit under 35 U.S.C. § 119(e) of U.S. Provisional Patent Application Ser. No. 60/692,906 filed Jun. 22, 2005.

BACKGROUND OF THE INVENTION

This invention relates generally to pencil sharpeners. More particularly, this invention relates to pencil sharpeners which are automatically actuated to sharpen a pencil.

SUMMARY OF THE INVENTION

Briefly stated, the invention in a preferred form is a pencil sharpener which comprises a base having a bottom surface adapted for being supported by a horizontal surface. A cutting assembly is mounted to the base and projects upwardly therefrom. A cage is disposed above the base and has an upper portion surrounding the cutting assembly. The upper portion of the cage includes at least one radial chute. An upper cover portion has an opening for insertion of an end of a pencil. A receptacle disposed above the base surrounds the cage, for collecting the shavings from sharpening a pencil.

The receptacle is vertically displaceable from the base for discarding the shavings. Alternatively, a cover disposed over the top of the receptacle may be removed for discarding the shavings.

The receptacle comprises an outer wall, an inner wall and an annular floor panel extending radially between the outer and inner walls. The inner wall extending axially only a portion of the axial extent of the outer wall. Preferably, the inner and outer walls are substantially cylindrical and are composed of transparent material.

The cage also has a lower portion disposed within said inner wall of said receptacle. The outer surface of the cage lower portion and the inner surface of the receptacle inner wall form a seal preventing the shavings from falling between the receptacle and the cage.

The pencil sharpener may further comprise a safety switch operable by the receptacle for preventing operation of the cutting assembly when the receptacle is not seated on the base. The safety switch includes an activator that is biased to extend upwardly from an upper rim of the base, the activator being pressed down against the biasing force when the receptacle is positioned on the base.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
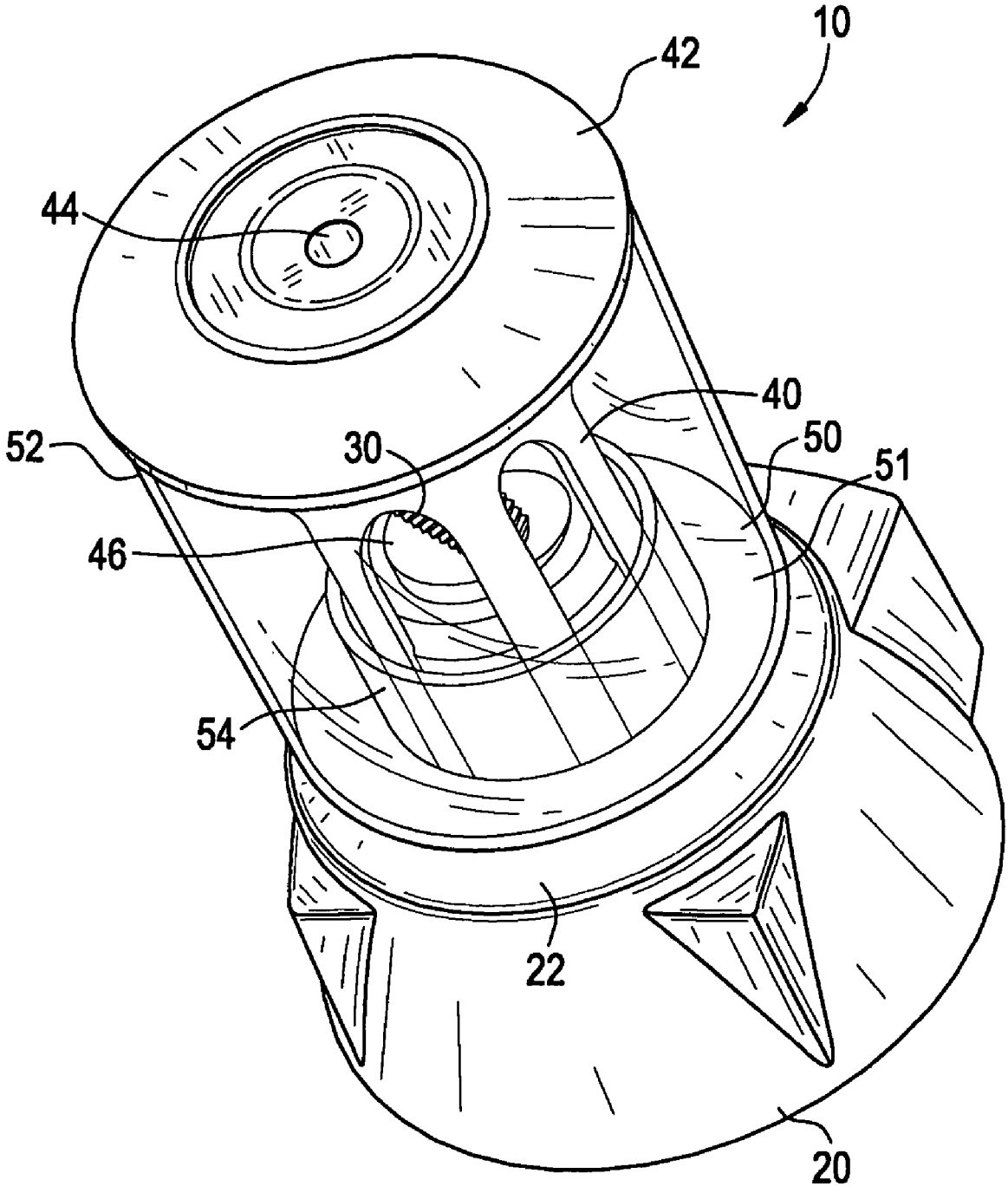
FIG. 1 is a perspective view of a pencil sharpener in accordance with the present invention.

With reference to the drawings wherein like numerals represent like parts throughout the several figures, a pencil sharpener in accordance with the present invention is generally designated by the numeral 10. Pencil sharpener 10 is an automatic pencil sharpener which may be powered by an external power supply or an internal battery. The pencil sharpener is adapted to be positioned on a desk top in an upright orientation for use as needed.

The pencil sharpener includes a base 20 which houses a motor (not illustrated). The top of the base is defined by an annular rim 22. A cutting assembly 24 is supported above the base 20. The motor provides, through a gear assembly, dual rotary movement for an obliquely oriented multi-helical cutting blade 30 of the cutting assembly 24. The blade 30 is preferably a titanium bonded blade.

A cage 40 is mounted above the base 20 and covers the blade 30. The cage 40 includes an end cap 42 which defines an opening 44 for insertion of the end of the pencil. An upper portion 45 of the cage 40 includes a plurality of equiangularly spaced openings which form chutes 46. The floor 48 of each chute 46 extends radially downward to facilitate transport of pencil shavings from the vicinity of the cutting blade 30 to a holding container 51 of the receptacle 50.

Figure 2:
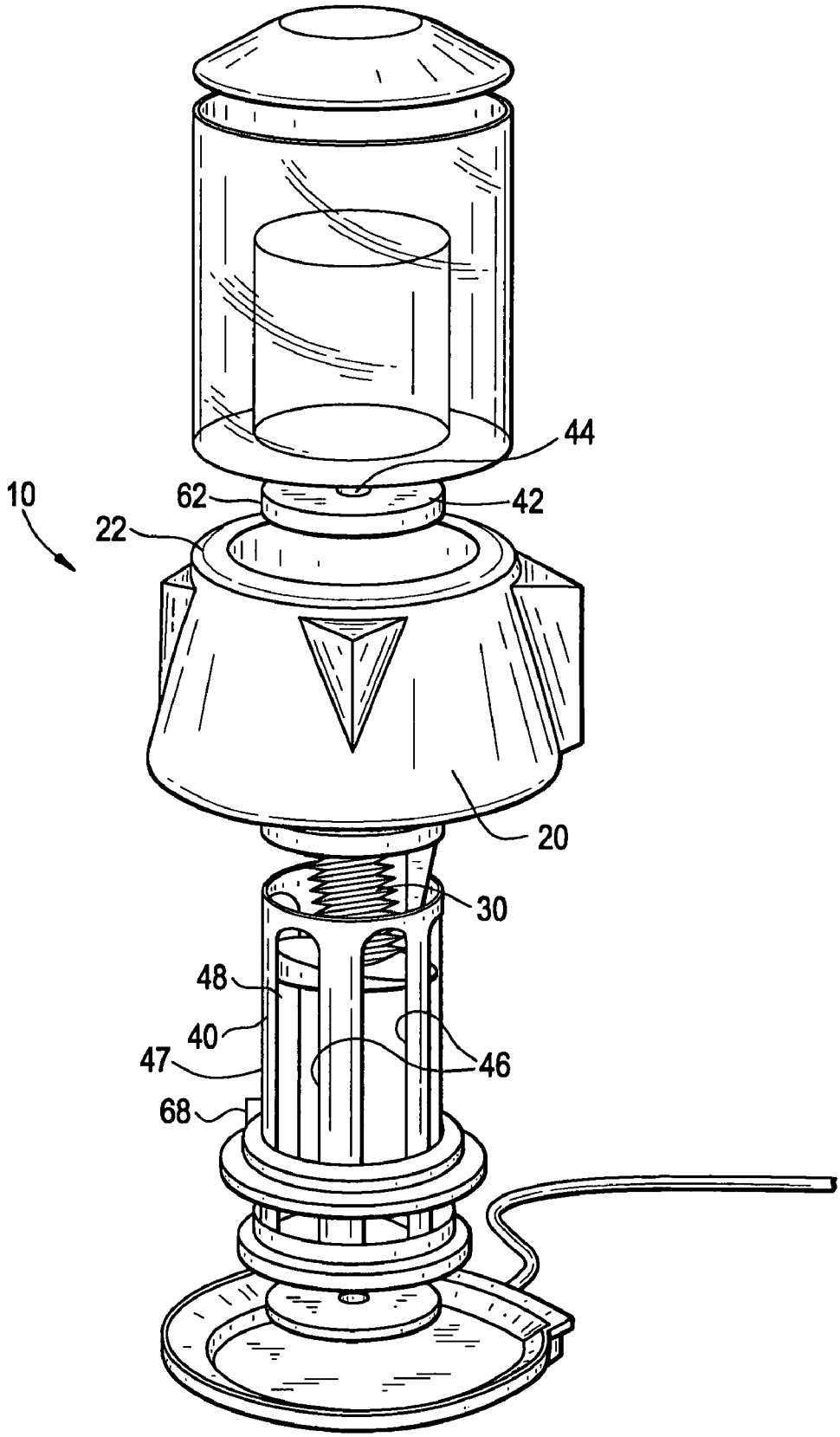
FIG. 2 is an exploded view of the pencil sharpener of FIG. 1.
Figure 3:
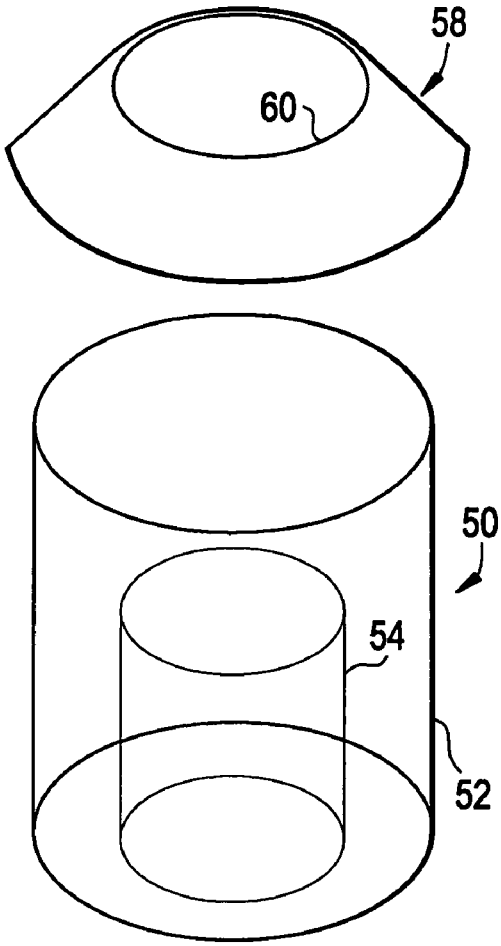
FIG. 3 is an enlarged view of the receptacle and cover of FIG. 2.
Figure 4:
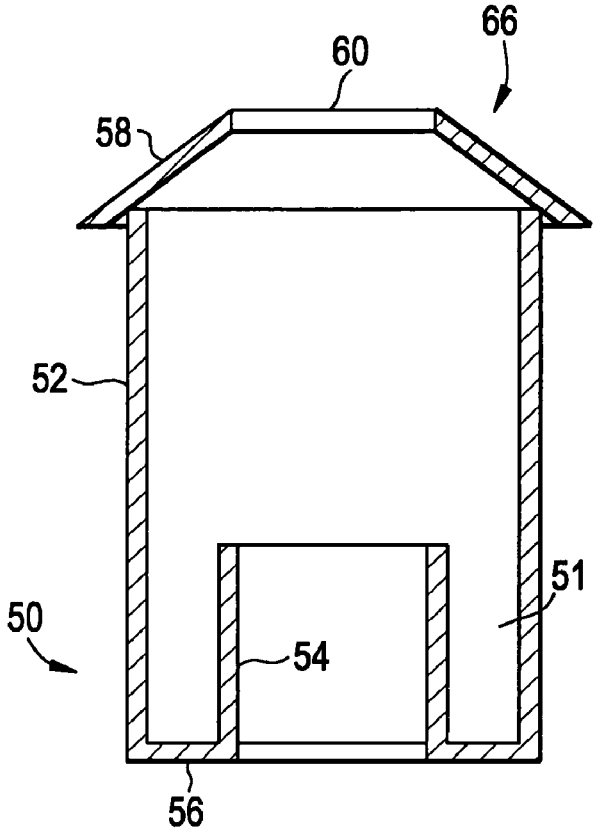
FIG. 4 is a cross-sectional view of the receptacle and cover of FIG. 3.
Figure 5:
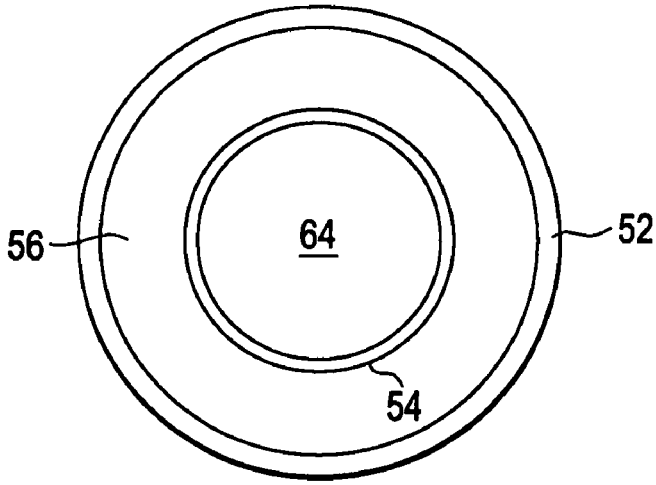
FIG. 5 is a top view of the receptacle and cover of FIG. 3.

The receptacle 50 surrounds the cage 40 and sits upright on the upper rim 22 of the base 20. The receptacle 50 has a tapered quasi-annular cover 58 which is removable from the receptacle as illustrated in FIG. 2. The inner periphery 60 of the cover 58 is complementary with the outer periphery 62 of the end cap 42. The receptacle 50 includes a substantially cylindrical outer wall 52, a coaxial substantially cylindrical inner wall 54 which surrounds a lower portion 47 of the cage 40, and an annular floor panel 56 extends radially between the bottoms of the outer and inner walls 52, 54. The inner and outer walls 54, 52, and the floor panel 56 form the vertically extending holding container 51 for retaining the pencil shavings.

It should be appreciated that the pencil sharpener 10 preferably has an aesthetically pleasing appearance. It should also be appreciated that the cylindrical shape of the inner and outer walls 54, 52 efficiently maximize the volume of the holding container 51, thereby maximizing the time that the pencil sharpener 10 may be used before the holding container 51 must be emptied. Further, a combination of the equiangularly spaced openings which form chutes 46 and the rotary motion of blade 30 causes the pencil shavings to be distributed uniformly around the periphery of the cage 40 and into the holding container 51. Preferably, at least the outer wall 52 of the receptacle 50 is composed of transparent material, allowing the user(s) to easily determine when the holding container 51 must be emptied.

In operation the end of a pencil to be sharpened is inserted from above the pencil sharpener 10 downwardly through the opening 44 between two feed rollers (not shown) of the cutting assembly 24. Contact of the end portion of the pencil with an activation switch (not shown) of the cutting assembly 24 automatically starts the motor which 1) turns the feed rollers in the infeed direction to pull the end portion of the pencil into the cutting assembly 24 and 2) turns the blade 30 in a first, sharpening direction to sharpen the pencil tip. The shavings removed during the sharpening operation are forced outwardly through the chutes 46 for downward collection in the holding container 51 of the receptacle 50 under the centrifugal rotary motion of the blade 30 and the force of gravity. When the cutting assembly 24 senses that the pencil tip has completed sharpening, the sharpener controller reverses the motor which 1) turns the blade 30 in the opposite direction to the sharpening direction and 2) turns the feed rollers in the outfeed direction to retract the end portion of the pencil out of the cutting assembly 24. When the end portion of the pencil has retracted such that the pencil is no longer in contact with the activation switch, the sharpener controller stops the motor.

The shavings retained in the holding container of the receptacle 50 may be removed by upwardly displacing the receptacle 50 from the base 20, thereby withdrawing the cage lower portion 47 from the opening 64 formed by the inner wall 54, and removing the receptacle 50 from the sharpener 10. The cover 58 may be removed to facilitate emptying the holding container 51 or the shavings may simply be removed through the central opening 66 of the cover 58. After the shavings have been discarded, the receptacle 50 is placed back into position on the base 20. Alternatively, the entire pencil sharpener 10 may be transported to a waste receptacle, the cover 58 removed, and the pencil sharpener 10 upended over the waste receptacle to discard the shavings. The cover 58 is then replaced and the pencil sharpener 10 returned to its work station for use.

The outer diameter of the cage lower portion 47 and the inside diameter of the inner wall 54 are selected to provide either a minimal clearance or a frictional fit between the cage lower portion 47 and the inner wall 54, to seal the gap between the receptacle 50 and the cage 40 and prevent shavings from falling between the receptacle 50 and the cage 40.

The control system for the sharpener 10 may include a safety switch 68 that prevents operation of the cutting assembly 24 when the receptacle 50 is not seated properly on the base 20. Preferably, the activator for safety switch 68 is spring biased to extend upwardly from the upper rim 22 of the base 20, and is pressed down against the biasing force by the inner wall 54, the outer wall 52, or the floor panel 56 when the receptacle 50 is positioned properly on the base 20. If the receptacle 50 is removed or raised above the base 20, safety switch 68 opens either the motor control circuit or the motor power circuit to prevent activation of the motor. If the receptacle 50 is properly positioned on the base 20, safety switch 68 closes, allowing the motor to be activated when a pencil is inserted into the cutting assembly 24. Accordingly, the outer wall 52 of the receptacle 50 precludes access to the cutting blade 30 though the chutes 46 whenever the motor may be activated.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A pencil sharpener comprising:

a base having a bottom surface adapted for being supported by a horizontal surface;

a cutting assembly mounted to the base and projecting upwardly therefrom;

a cage disposed above the base and having an upper portion surrounding the cutting assembly, said upper portion of said cage defining a plurality of radial chutes and having an upper cover portion defining an opening for insertion of an end of a pencil; and a receptacle surrounding said cage and disposed above said base for collecting the shavings from sharpening a pencil.

2. A pencil sharpener comprising:

a base having a bottom surface adapted for being supported by a horizontal surface;

a cutting assembly mounted to the base and projecting upwardly therefrom;

a cage disposed above the base and having an upper portion surrounding the cutting assembly, said upper portion of said cage defining at least one radial chute and having an upper cover portion defining an opening for insertion of an end of a pencil; and a receptacle surrounding said cage and disposed above said base for collecting the shavings from sharpening a pencil, wherein the receptacle is vertically displaceable from the base for discarding the shavings.

3. The pencil sharpener of claim 1 further comprising a cover disposed over a top of the receptacle, the cover being removable for discarding the shavings.

4. A pencil sharpener comprising:

a base having a bottom surface adapted for being supported by a horizontal surface;

a cutting assembly mounted to the base and projecting upwardly therefrom;

a cage disposed above the base and having an upper portion surrounding the cutting assembly, said upper portion of said cage defining at least one radial chute and having an upper cover portion defining an opening for insertion of an end of a pencil; and a receptacle surrounding said cage and disposed above said base for collecting the shavings from sharpening a pencil, wherein the receptacle comprises an outer wall, an inner wall and an annular floor panel extending radially between the outer and inner walls, the inner wall extending axially only a portion of the axial extent of the outer wall.

5. The pencil sharpener of claim 4 wherein the cage also has a lower portion disposed within said inner wall of said receptacle.

6. The pencil sharpener of claim 4 wherein the inner and outer walls are substantially cylindrical.

7. The pencil sharpener of claim 4 wherein the outer wall is composed of a transparent material.

8. The pencil sharpener of claim 7 wherein the inner wall is composed of a transparent material.

9. The pencil sharpener of claim 5 wherein the cage lower portion has an outer surface and the inner wall has an inner surface, the outer surface of the cage lower portion and the inner surface of the receptacle inner wall defining a seal preventing the shavings from falling between the receptacle and the cage.

10. The pencil sharpener of claim 1 further comprising a safety switch operable by the receptacle for preventing operation of the cutting assembly when the receptacle is not seated on the base.

11. The pencil sharpener of claim 10 wherein the safety switch comprises an activator that is biased to extend upwardly from an upper rim of the base, the activator being pressed down against the biasing force when the receptacle is positioned on the base.

12. A pencil sharpener comprising:

a base including an upper rim and a bottom surface adapted for being supported by a horizontal surface;

a cutting assembly mounted to the base and projecting upwardly therefrom;

a cage disposed above the base and having a lower portion extending a height from the base upper rim, an upper portion surrounding the cutting assembly, said upper portion defining at least one radial chute, and an upper cover portion defining an opening for insertion of an end of a pencil; and a receptacle surrounding said cage and disposed above said base, the receptacle including a transparent outer wall, an inner wall surrounding the cage lower portion, the inner wall having a height substantially equal to the height of the cage lower portion, and an annular floor panel extending radially between the outer and inner walls, the outer wall, inner wall and floor panel defining a holding container for collecting the shavings from sharpening a pencil.

13. The pencil sharpener of claim 12 wherein the inner and outer walls are substantially cylindrical.

14. The pencil sharpener of claim 12 wherein the inner wall is composed of a transparent material.

15. The pencil sharpener of claim 12 wherein the cage lower portion has an outer surface and the inner wall has an inner surface, the outer surface of the cage lower portion and the inner surface of the receptacle inner wall defining a seal preventing the shavings from falling between the receptacle and the cage.

16. The pencil sharpener of claim 12 further comprising:

a motor connected to the cutting assembly; and a safety switch operable by the receptacle for preventing operation of the motor when the receptacle is not seated on the base.

17. The pencil sharpener of claim 16 wherein the safety switch comprises an activator that is biased to extend upwardly from the base upper rim, the activator being pressed down against the biasing force when the receptacle is positioned on the base.

18. The pencil sharpener of claim 12, wherein the receptacle is vertically displaceable for removal from the base for discarding the shavings.

19. The pencil sharpener of claim 12 further comprising a cover disposed over a top of the receptacle, the cover being removable for discarding the shavings.

20. A pencil sharpener comprising:

a base including an upper rim and a bottom surface adapted for being supported by a horizontal surface;

a motor dispose within the base;

a cutting assembly mounted to the base and projecting upwardly therefrom, the cutting assembly being connected to the motor;

a cage disposed above the base and having a lower portion extending a height from the base upper rim, an upper portion surrounding the cutting assembly, said upper portion defining at least one radial chute, and an upper cover portion defining an opening for insertion of an end of a pencil;

a receptacle surrounding said cage and disposed above said base, the receptacle including a transparent, substantially cylindrical outer wall, a transparent, substantially cylindrical inner wall surrounding the cage lower portion, the inner wall having a height substantially equal to the height of the cage lower portion, and an annular floor panel extending radially between the outer and inner walls, the outer wall, inner wall and floor panel defining a holding container for collecting the shavings from sharpening a pencil; and a safety switch operable by the receptacle for preventing operation of the motor when the receptacle is not seated on the base.

* * * * *